US006431470B2

(12) United States Patent
Berg

(10) Patent No.: US 6,431,470 B2
(45) Date of Patent: Aug. 13, 2002

(54) LOW-NOISE AIR NOZZLE

(75) Inventor: Frederic P. Berg, Seattle, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/791,944

(22) Filed: Feb. 23, 2001

Related U.S. Application Data

(60) Provisional application No. 60/185,018, filed on Feb. 25, 2000.

(51) Int. Cl.[7] ..... B05B 1/14

(52) U.S. Cl. ..... 239/548; 239/290; 239/291; 239/296; 239/550; 239/553.5; 239/DIG. 22

(58) Field of Search ..... 239/290, 291, 239/296, 548, 550, 552, 553.5, 556, 557, 558, 559, 567, 590.5, DIG. 21, DIG. 22, 596

(56) References Cited

U.S. PATENT DOCUMENTS

| | | | | |
|---|---|---|---|---|
| 1,721,381 A | * | 7/1929 | Ellis | 239/552 X |
| 3,895,757 A | * | 7/1975 | Di Loreto | 239/291 |
| 3,973,642 A | | 8/1976 | Dahlquist | 181/36 A |
| 4,050,632 A | * | 9/1977 | Wyse | 239/552 X |
| 4,438,907 A | * | 3/1984 | Kimura et al. | 239/556 X |
| 4,721,249 A | * | 1/1988 | Lassiter | 239/DIG. 21 |
| 5,050,805 A | | 9/1991 | Lloyd et al. | 239/424 |

* cited by examiner

*Primary Examiner*—Robin O. Evans
(74) *Attorney, Agent, or Firm*—Lawrence W. Nelson

(57) ABSTRACT

A low-noise air delivery system including a nozzle plate having a plurality of tubes. Each tube acts as an independent nozzle with an external diameter (d). Each tube is spaced approximately two external diameters (2d) apart from an adjacent tube. The system also includes a hand-held portion coupled to the nozzle plate engageable to and in communication with an air supply.

3 Claims, 6 Drawing Sheets

LOW-NOISE AIR NOZZLE

This application claims priority from Provisional application Ser. No. 60/185,018, filed Feb. 25, 2000.

FIELD OF THE INVENTION

The present invention relates to a nozzle used for supplying compressed air to clean machines or work pieces, and more particularly, to a nozzle designed for supplying adequate amounts of compressed air at acceptable noise levels.

BACKGROUND OF THE INVENTION

Nozzles may be used for a variety of purposes including the cleaning of machines and work pieces. Nozzles may be operated automatically, or they may be hand-held by an operator who directs the exiting flow. Unfortunately, operator-held nozzles have a significant problem in that the level of noise emitted by the nozzle during operation can be unacceptably high when used for a significant period of time. Furthermore, when nozzles are used in an enclosed area, such as a factory, the reflective surfaces of the area can tend to increase the noise level.

A sound pressure level of 120 decibels has been determined by OSHA to be the threshold level of pain for a human being. In occupational situations, OSHA limits the exposure level of a person to noise levels of less than 90 dBA for an eight-hour period. Unfortunately, typical prior art nozzles used for particle blast cleaning apparatuses have been measured to emit noise levels as high as 130 decibels at an operator's position.

Attempts within the industry have been made to reduce the noise level from air nozzles, such as that used on a safety air gun 200, shown in FIG. 1. The safety gun 200 includes a plug 202, which acts as a standoff from an operator. If any more than 30 psig of compressed air were to directly contact the skin of an operator, then the pressure could produce an air embolism within the operator. Thus, the plug 202 is a significant safety feature. The safety gun 200 further includes a plurality of small diameter holes 204 surrounding the plug 202. Airflow comes from the small diameter holes 204, which generate high-frequency noise, effectively lowering the noise level emitted by the gun 200. However, the safety gun 200 is limited by the number of holes 204 surrounding the plug 202. This limitation drastically reduces the output pressure and hence the performance and cleaning abilities of the gun 200.

Clearly, there is a need in the art for an air nozzle that can provide a significant amount noise reduction while not reducing the output pressure and hence the effectiveness of the nozzle.

SUMMARY OF THE INVENTION

According to one aspect, the present invention relates to a low-noise air delivery system including a nozzle plate having a plurality of tubes. Each tube acts as an independent nozzle with an external diameter (d). Also, each tube is spaced approximately two external diameters (2d) apart from an adjacent tube. The system further includes a hand-held portion coupled to the nozzle plate engageable to and in communication with an air supply.

BRIEF DESCRIPTION OF THE DRAWINGS

The features, aspects, and advantages of the present invention will become better understood with regard to the following drawings where.

DETAILED DESCRIPTION OF PREFERRED EMBODIMENTS

The present invention relates to a low-noise air delivery system for cleaning machines or work pieces and includes a nozzle that provides a blowing force greater than most prior art air nozzles while still reducing the noise level at an operator's position.

Figure 1:
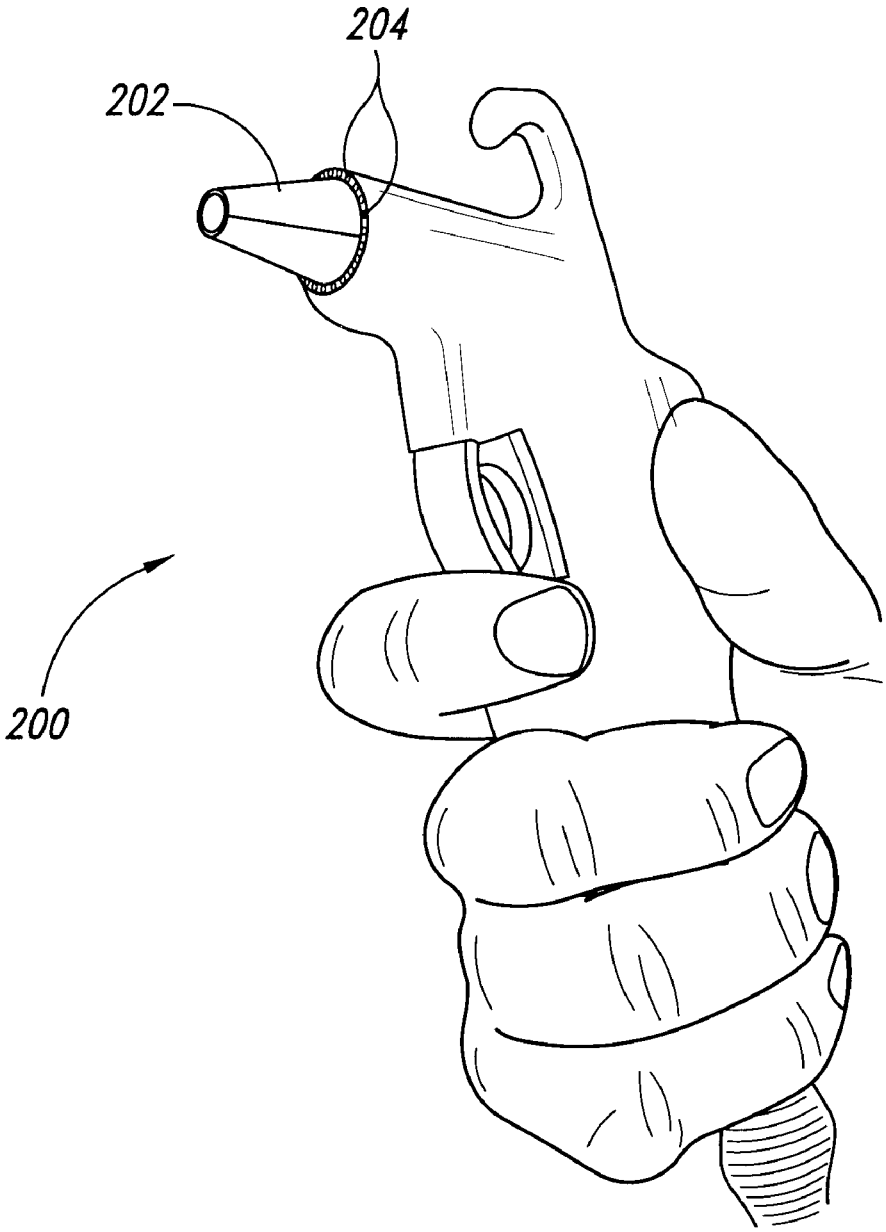
Fig. 1 (Prior Art)
FIG. 1 is a perspective view of a prior art air delivery system.
Figure 2:
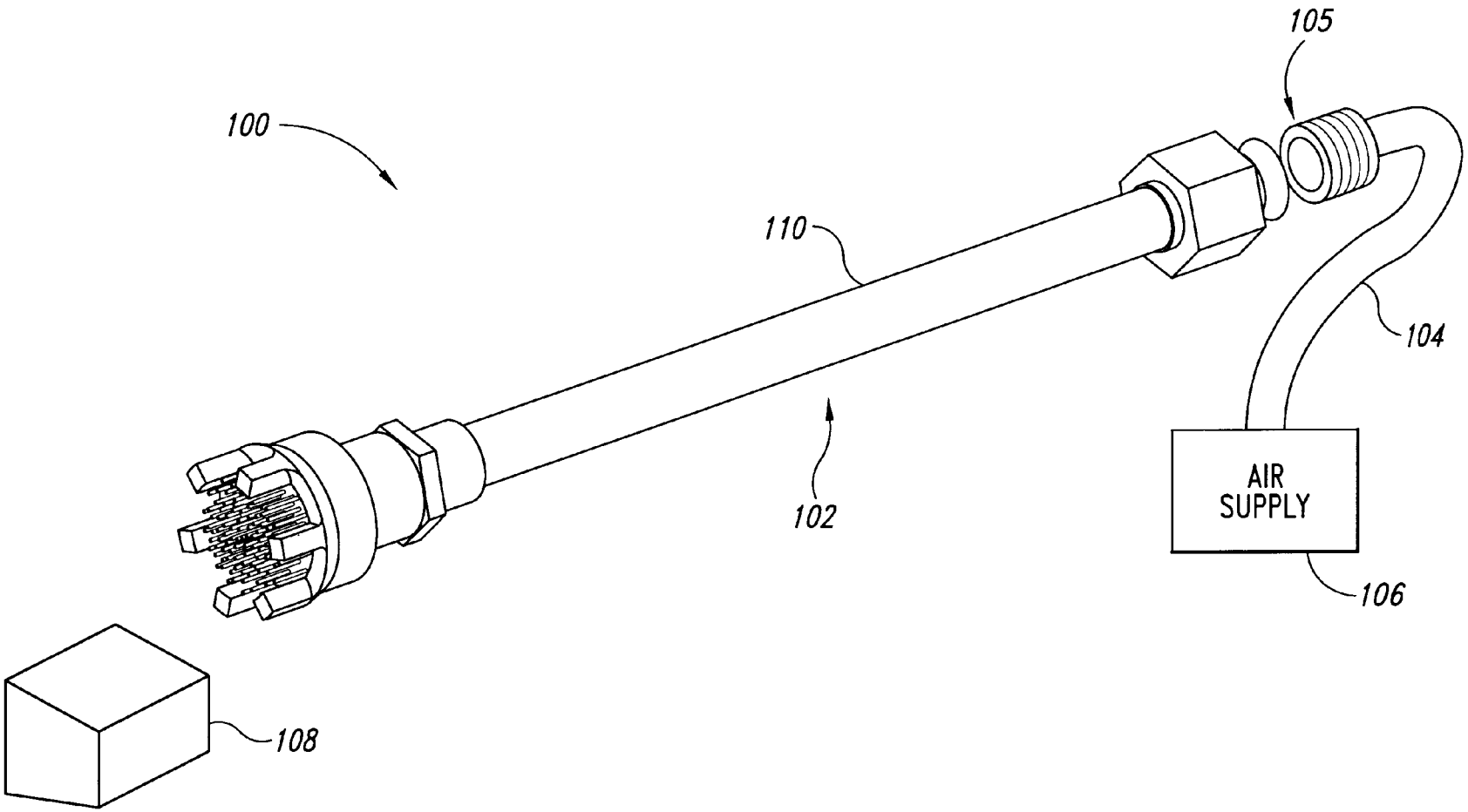
FIG. 2 is a perspective view of a low-noise air delivery system of the present invention.
Figure 3:
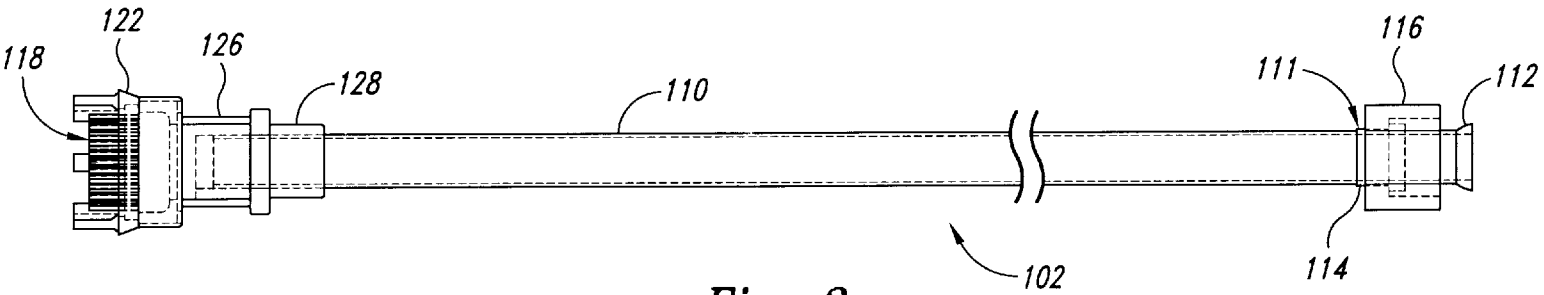
FIG. 3 is a side view of the low-noise air delivery system.

As shown in FIGS. 2 and 3, the low-noise air delivery system 100 includes a hand-held portion 102, an air hose 104, and an air supply system 106 for applying pressurized air to an object 108.

The hand-held portion 102 of the low-noise air delivery system 100 includes a tube 110, preferably stainless steel, having a proximal end and a distal end. The proximal end 111 of the tube 110 has a flare 112. The flare 112 retains a tube end nut 114 and a tube end sleeve 116 which are used to threadingly engage a distal end 105 of the hose 104.

The low-noise air delivery system 100 further includes a nozzle plate 118, as shown in FIGS. 2, 3 and 4*a*–4*c*. The nozzle plate 118 has a plurality of independent nozzles 120. Each of the nozzles 120 consists of a tube having an external diameter (d). Each one of the nozzles 120 is spaced approximately two diameters (2·d) apart from an adjacent nozzle. This preferred spacing provides sufficient separation to entrain outside ambient air while not allowing primary air streams to mix together to create a larger air stream, which would cause unwanted noise.

In a preferred embodiment, the nozzle plate 118 would include 93 mini nozzles 120, each mini nozzle 120 having an inside diameter of 0.040 inches and an outside/external diameter of 0.062 inches. The present invention divides the nozzle flow area into several smaller flow areas. The small flow areas defined by the diameter of the tube-shaped nozzles 120 cause the airflow to only generate small turbulent eddies which produce much lower noise levels. Also, the size of the nozzles 120 only generate higher frequencies, which are less damaging to an operator's hearing.

Figure 4B:
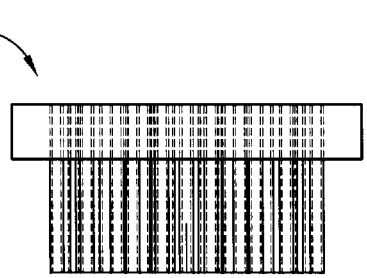
FIG. 4*b* is a side view of the nozzle plate.
Figure 4A:
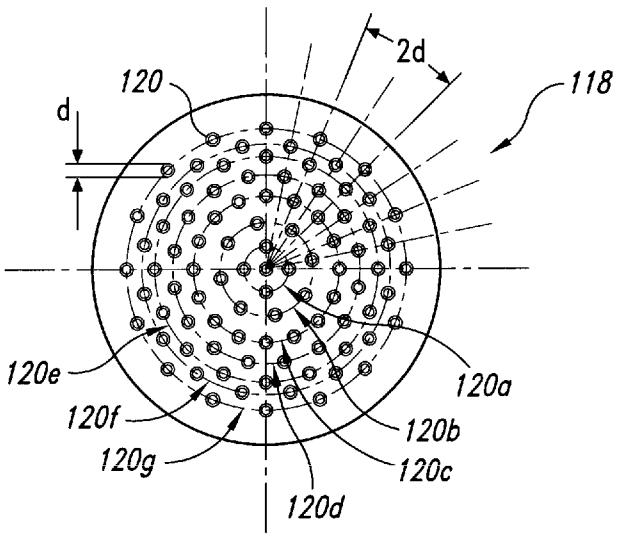
FIG. 4*a* is a front view of a nozzle plate of the low-noise air delivery system.
Figure 4C:
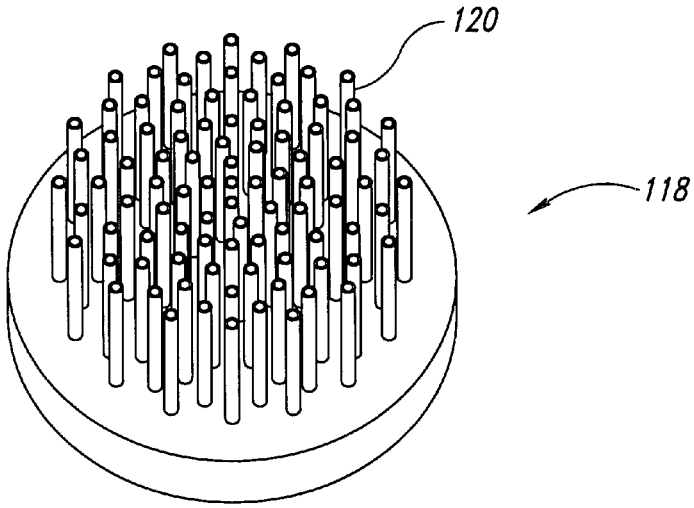
FIG. 4*c* is a perspective view of the nozzle plate.

As shown in FIG. 4*a,* the nozzle plate 118 preferably includes nozzles 120 located within concentric circles, such as seven separate radiuses, and is preferably constructed from a single molded urethane plate. The innermost radius RI has four equally spaced tubes 120*a.* The second radius has eight equally spaced tubes 120*b.* The third radius R3 includes 16 equally spaced tubes 120*c.* The fourth radius R4 has 16 equally spaced tubes 120*d.* The fifth radius R5 has 16 equally spaced tubes 120*e.* The sixth radius R6 has 16 equally spaced tubes 120*f,* and the seventh radius R7 includes 16 equally spaced tubes 120*g.* These multiple flows reduce noise by shielding the inner higher velocity air flows with the outer slower moving air. Also, this geometry does not limit the maximum number of nozzles within the plate 118.

Figure 4D:
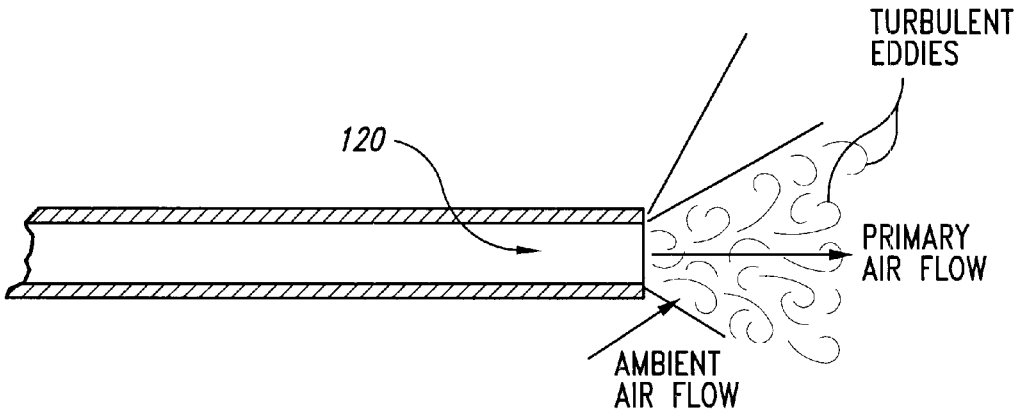
FIG. 4*d* is a pictorial example of the operation of a nozzle within the nozzle plate.
Figure 5A:
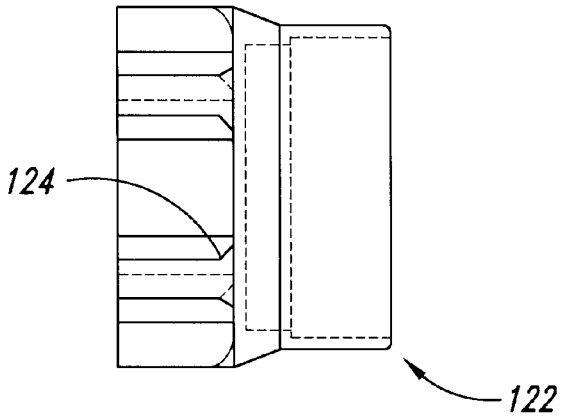
FIG. 5*a* is a side view of a distal end of a nozzle housing of the low-noise air delivery system.
Figure 5B:
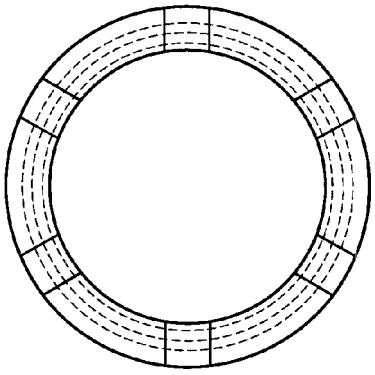
FIG. 5*b* is a front view of the distal end of the nozzle housing.
Figure 5C:
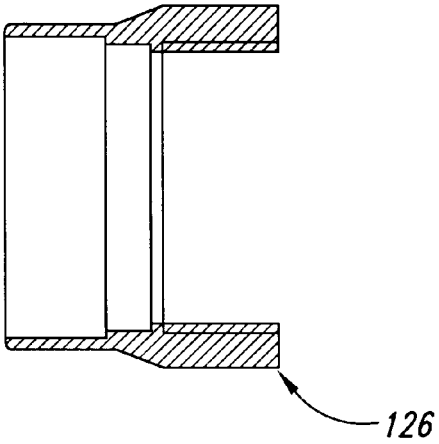
FIG. 5*c* is a side view of a proximal end of the nozzle housing.

By spacing each nozzle 120 approximately two diameters (2d) apart, the configuration is optimized for maintaining an efficient mixing of primary and ambient airflows. Further, the thin wall of the tube-shaped nozzles 120 provides efficient mixing of the two air streams, primary and ambient, and comes into play at the nozzle exit. Ambient air mixes along the nozzle's perimeter a full 360 degrees at the exit of each nozzle 120. The thin edges of the nozzle allow smooth flow of the two air streams to generate the lowest turbulence, as shown in FIG. 4*d*. Noise generated from the center nozzles 120*a*–120*f* will be shielded by the nozzles 120*g* on the outside edge.

Figure 6A:
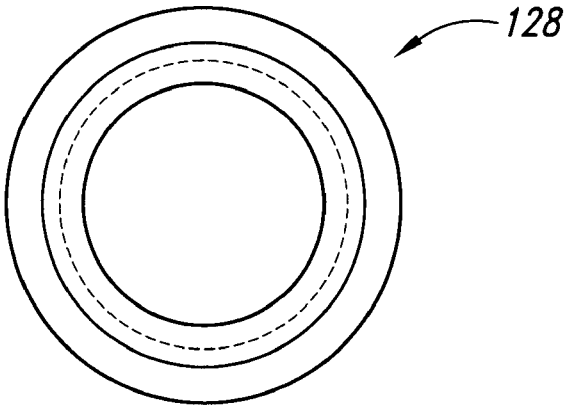
FIG. 6*a* is a front view of an adapter fitting of the low-noise air delivery system.
Figure 6B:
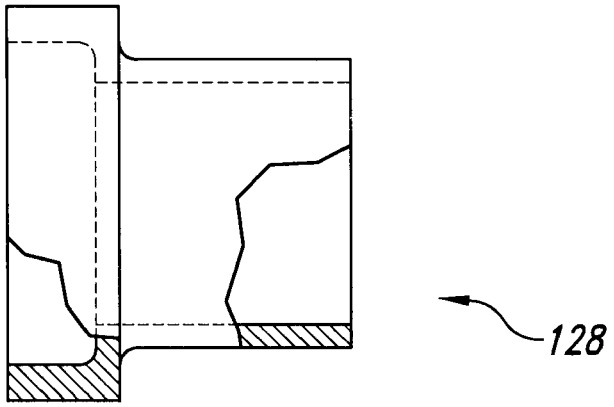
FIG. 6*b* is a side view of the adapter fitting.

As shown in FIGS. 2, 3, and 5*a*–5*c*, the low-noise air delivery system 100 further includes a nozzle housing 122 which operates to retain the nozzle plate 118 and provides standoffs 124 for safe hand-held operation. A proximal end 126 of the housing 122 is used to engage an adapter fitting 128. The adapter fitting 128, also shown in FIGS. 6*a* and 6*b*, is preferably weld fitted to the tube 110.

To operate the low-noise air delivery system 100, an operator simply turns on the air supply 106. This task can be performed by either activating an air compressor, or by turning a valve on a much larger air supply system, allowing pressurized air to pass through the hose 104 into the tube 110. The pressurized air exits through each of the plurality of nozzles 120 to provide a substantial blowing force to the object 108 at a reduced noise level. The table below shows test results comparing the low-noise air delivery system 100 against a prior art system. The blowing force was measured by holding the nozzle plate 118 12 inches away from a digital scale platform. Noise was measured 3 feet behind the nozzle exit (operator position) and 3 feet perpendicular to the nozzle exit (side line). The table shows that the low-noise nozzle had a 3% increase in blowing force and a 15 dBA noise reduction at the operator position.

| Nozzle Type | Blowing Force from 12 inches | Side Line Level at 3 ft. | Operator Noise Level at 3 ft. | Ambient Noise Level |
|---|---|---|---|---|
| Prior Art | 6.4 lbs | 104 dBA | 103 dBA | 87 dBA |
| Low-Noise | 6.6 lbs | 94 dBA | 88 dBA | 87 dBA |

Consequently, the low-noise air delivery system 100 of the present invention provides more than adequate blowing force compared to prior art air delivery systems, but at a substantially lower noise level.

While the detailed description above has been expressed in terms of specific examples, those skilled in the art will appreciate that many other configurations could be used to accomplish the purpose of the disclosed inventive apparatus. Accordingly, it will be appreciated that there are equivalent modifications to the above-described embodiments that may be made without departing from the spirit and scope of the invention. Therefore, the invention is to be limited only by the following claims.

What is claimed is:

1. A low-noise air delivery system comprising:

a nozzle plate including a plurality of tubes, each tube acting as an independent nozzle with an external diameter (d), wherein each tube is spaced approximately two external diameters (2d) apart from an adjacent tube, and wherein the nozzle housing includes a plurality of stand-off members surrounding the plurality of tubes;

a nozzle housing for holding said nozzle plate in position; and a hand-held portion coupled to the nozzle plate engageable to and in communication with an air supply.

2. A low-noise air delivery system comprising:

a nozzle plate including a plurality of tubes, each tube acting as an independent nozzle with an external diameter (d), wherein each tube is spaced approximately two external diameters (2d) apart from an adjacent tube;

a nozzle housing for holding said nozzle plae in position;

a hand-held portion coupled to the nozzle plate engageable to and in communication with an air supply; and an adapter fitting for coupling the nozzle housing to said hand-held portion.

3. The system according to claim 2 wherein the hand-held portion includes a stainless-steel tube, and wherein a distal end of said tube is weld-fitted to said adapter.

* * * * *